US010304403B2

(12) United States Patent
Chen et al.

(10) Patent No.: US 10,304,403 B2
(45) Date of Patent: May 28, 2019

(54) DISPLAY APPARATUS AND DRIVE CIRCUIT THEREOF

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Shuai Chen, Beijing (CN); Zhi Zhang, Beijing (CN); Siqing Fu, Beijing (CN); Lisheng Liang, Beijing (CN); Xianyong Gao, Beijing (CN); Jianghong Wen, Beijing (CN); Qian Qian, Beijing (CN); Xiuzhu Tang, Beijing (CN); Zhihui Wang, Beijing (CN); Lei Chen, Beijing (CN); Taoliang Tang, Beijing (CN); Gang Chen, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 15/518,230

(22) PCT Filed: Sep. 12, 2016

(86) PCT No.: PCT/CN2016/098692

§ 371 (c)(1),
(2) Date: Apr. 10, 2017

(87) PCT Pub. No.: WO2017/080298

PCT Pub. Date: May 18, 2017

(65) Prior Publication Data

US 2018/0240425 A1 Aug. 23, 2018

(30) Foreign Application Priority Data

Nov. 9, 2015 (CN) ..... 2015 1 0758470

(51) Int. Cl.
*G06F 3/038* (2013.01)
*G09G 3/36* (2006.01)

(52) U.S. Cl.
CPC ..... *G09G 3/3674* (2013.01); *G09G 3/36* (2013.01); *G09G 3/3614* (2013.01);
(Continued)

(58) Field of Classification Search
CPC ..... G09G 3/3674; G09G 3/36; G09G 3/3614; G09G 2310/067
(Continued)

(56) References Cited

U.S. PATENT DOCUMENTS 6,020,867 A * 2/2000 Shimada ..... G02B 6/0086 345/87
2001/0033266 A1* 10/2001 Lee ..... G09G 3/3677 345/94
2005/0206803 A1* 9/2005 Suzuki ..... G09G 3/3406 349/61
2008/0225035 A1 9/2008 Hsu et al.
2009/0219242 A1* 9/2009 Fuchigami ..... G09G 3/3648 345/100
(Continued)

FOREIGN PATENT DOCUMENTS

CN 101315749 A 12/2008
CN 101644867 A 2/2010
(Continued)

OTHER PUBLICATIONS

2nd Office Action dated Nov. 3, 2017 in CN201510758470.9.
(Continued)

*Primary Examiner* — Jonathan M Blancha
(74) *Attorney, Agent, or Firm* — Syncoda LLC; Feng Ma

(57) ABSTRACT

The present disclosure provides a display drive circuit for driving a display panel having a plurality of pixels. The display drive circuit comprises a stepping unit, configured to shape a gate voltage signal to compensate for pixel-to-pixel charging variations to thereby reduce luminance variations on the display panel. The display drive circuit can further include a time sequence control unit and a modulation unit. The time sequence control unit can be coupled to the modulation unit, and can be configured to generate a first control signal; and the modulation unit can be configured to utilize the first control signal to modulate a preset signal to thereby generate a second control signal; and the stepping unit can be coupled to the modulation unit, and can be configured to shape the gate voltage signal based on the second control signal prior to outputting the gate voltage signal.

15 Claims, 7 Drawing Sheets

(52) U.S. Cl.
CPC ... *G09G 2310/067* (2013.01); *G09G 2310/08* (2013.01); *G09G 2320/0209* (2013.01); *G09G 2320/0233* (2013.01)

(58) Field of Classification Search
USPC ..... 345/208
See application file for complete search history.

(56) References Cited

U.S. PATENT DOCUMENTS

| | | | | |
|---|---|---|---|---|
| 2010/0245333 | A1* | 9/2010 | Hsu | G09G 3/3648 345/213 |
| 2014/0362073 | A1* | 12/2014 | Huang | G09G 3/3674 345/213 |
| 2015/0261233 | A1* | 9/2015 | Duan | G09G 3/20 345/101 |
| 2017/0278456 | A1* | 9/2017 | Dan | G09G 3/3225 |

FOREIGN PATENT DOCUMENTS

| | | | |
|---|---|---|---|
| CN | 102034440 | A | 4/2011 |
| CN | 102622987 | A | 11/2012 |
| CN | 103258514 | A | 8/2013 |
| CN | 103366822 | A | 10/2013 |
| CN | 104778937 | A | 7/2015 |

OTHER PUBLICATIONS

1st Office Action dated Jun. 2, 2017 in CN201510758470.9.
International Search Report and Written Opinion dated Dec. 15, 2016 in PCT/CN2016/098692.

* cited by examiner

DISPLAY APPARATUS AND DRIVE CIRCUIT THEREOF

CROSS-REFERENCE TO RELATED APPLICATION

The present application claims priority to Chinese Patent Application No. 201510758470.9 filed on Nov. 9, 2015, the disclosure of which is hereby incorporated by reference in its entirety.

TECHNICAL FIELD

The present disclosure relates to the field of display technologies, and more specifically to a display drive circuit, a display apparatus and a display drive method.

BACKGROUND

Consumers have an increasingly higher demand for better display effects of display devices. With the technological advances in the modern era, liquid crystal displays (LCD), and organic light emitting diode (OLED) have been widely employed in electronic display products, such as televisions, computers, cellular phones, and personal digital assistants.

For example, an LCD comprises source drivers, gate drivers, and an LCD panel, etc. The LCD panel comprises a pixel array. The gate drivers are employed to sequentially turn on corresponding pixel rows in the pixel array, so as to transmit the pixel data output from the source drivers to pixels to display images.

SUMMARY

The present disclosure provides a display drive circuit, a display apparatus, and a display drive method, aiming at solving the problem of significant differences in charging affects among the pixels connected to different rows of gate scan lines in current display technologies.

In a first aspect, the present disclosure provides a display drive circuit for driving a display panel having a plurality of pixels. The display drive circuit comprises a stepping unit, configured to shape a gate voltage signal to compensate for pixel-to-pixel charging variations to thereby reduce luminance variations on the display panel.

The display drive circuit can further include a time sequence control unit and a modulation unit. The time sequence control unit can be coupled to the modulation unit, and can be configured to generate a first control signal; and the modulation unit can be configured to utilize the first control signal to modulate a preset signal to thereby generate a second control signal; and the stepping unit can be coupled to the modulation unit, and can be configured to shape the gate voltage signal based on the second control signal prior to outputting the gate voltage signal.

In the display drive circuit, the time sequence control unit can be configured to additionally generate a row selection signal, wherein the row selection signal can be configured to control effectiveness of the modulation unit in each clock cycle.

In the display drive circuit as described above, the stepping unit can be configured to shape at least one of a width and a depth of a step over a pulse waveform of the gate voltage signal.

In some embodiments of the display drive circuit as described above, the preset signal can include at least one of a step depth signal and a step width signal. The first control signal can comprise at least one of a depth modulation signal and a width modulation signal, wherein the modulation unit can be configured to utilize the depth modulation signal to modulate the step depth signal, and to utilize the width modulation signal to modulate the step width signal. The second control signal can comprise at least one of a modulated step depth signal and a modulated step width signal.

In some of the above embodiments, the modulation unit of the display drive circuit can comprise at least one of a depth modulation module and a width modulation module. The depth modulation module can be configured to adjust an amplitude of the step depth signal based on the depth modulation signal; and the width modulation module can be configured to adjust an amplitude of the step width signal based on the width modulation signal.

In some embodiments of the display drive circuit, the depth modulation module can comprise a first digital rheostat. A control terminal of the first digital rheostat can be coupled to a terminal for the depth modulation signal. A first terminal of the first digital rheostat can be coupled to a common terminal; and a second terminal of the first digital rheostat can be coupled to the stepping unit, and can be coupled to a terminal for the step depth signal via a first resistor.

The depth modulation signal can comprise a preset number of square wave pulses in each clock cycle, and the first digital rheostat can be configured to determine a resistance between the first terminal and the second terminal according to a number of square wave pulses received by the control terminal in each clock cycle.

In some embodiments of the display drive circuit, the width modulation module can be configured to adjust forward or backward a phase of the step width signal in each time period when the row selection signal is an effective voltage potential according to the width modulation signal.

The width modulation module can include an operational amplifier, a first transistor, a second transistor, a second digital rheostat, a first capacitor, and a trigger.

A non-inverting terminal and an inverting terminal of the operational amplifier can be respectively coupled to a terminal for the row selection signal and a terminal for a preset off-set voltage, and an output terminal of the operational amplifier can be coupled to a gate of the first transistor and a gate of the second transistor.

The first transistor and the second transistor can comprise at least one of a P-type transistor or an N-type transistor. One of a source electrode or a drain electrode of the first transistor can be coupled to a terminal for the step width signal, and another one of the source electrode or the drain electrode of the first transistor can be coupled to a first terminal of the second digital rheostat. One of a source electrode or a drain electrode of the second transistor can be coupled to the terminal for the step width signal, and another one of the source electrode or the drain electrode of the second transistor can be coupled to the stepping unit.

A control terminal of the second digital rheostat can be coupled to a terminal for the width modulation signal; a second terminal of the second digital rheostat can be coupled to an input terminal of the trigger, and can be coupled to the common terminal via two terminals of the first capacitor.

An output terminal of the trigger can be coupled to the stepping unit, and can be configured to output a high electric potential if the input terminal of the trigger is higher than a preset electric potential.

In some embodiments of the display drive circuit as described above, the width modulation signal can comprise a preset number of square wave pulses in each clock cycle, and the second digital rheostat can be configured to determine a resistance between the first terminal and the second terminal according to a number of square wave pulses received by the control terminal in each clock cycle.

In some embodiments of the display drive circuit, a width of a step of the gate voltage signal can be determined by a distance between a rising edge of the modulated step width signal and a rising edge of a gate control signal.

In a second aspect, the present disclosure provides a display apparatus, comprising the display drive circuit according to any of the embodiments as described above.

In some embodiments of the display apparatus, the display apparatus can further comprise a scan drive circuit, which can be coupled to the stepping unit and configured to receive the gate voltage signal from the stepping unit.

The display apparatus can further comprise a display panel having a plurality of pixels.

In a third aspect, the present disclosure provides a display drive method. The display drive method comprises:

Shaping a gate voltage signal to compensate for pixel-to-pixel charging variations to thereby reduce luminance variations on a display panel.

In some embodiments of the display drive method, shaping a gate voltage signal comprises:

Generating a first control signal;

Modulating a preset signal based on the first control signal to thereby generate a second control signal; and Shaping the gate voltage signal based on the second control signal prior to outputting the gate voltage signal.

In some of the embodiments of the display drive method, shaping the gate voltage signal comprises:

Shaping a step over a pulse waveform of the gate voltage signal.

In some embodiments of the display drive method, shaping a step over a pulse waveform of the gate voltage signal comprises at least one of adjusting a width of the step over the pulse waveform of the gate voltage signal; and adjusting a depth of the step over the pulse waveform of the gate voltage signal.

In some embodiments of the display drive method, the preset signal comprises at least one of a step depth signal and a step width signal, and as such:

Generating a first control signal comprises: generating at least one of a depth modulation signal and a width modulation signal;

Modulating a preset signal based on the first control signal to thereby generate a second control signal comprises at least one of: modulating the step depth signal based on the depth modulation signal to thereby generate a modulated step depth signal; and modulating the step width signal based on the width modulation signal to thereby generate a modulated step width signal; and Shaping the gate voltage signal based on the second control signal prior to outputting the gate voltage signal comprises at least one of: shaping the gate voltage signal based on the modulated step depth signal prior to outputting the gate voltage signal; and shaping the gate voltage signal based on the modulated step width signal prior to outputting the gate voltage signal.

In some embodiments of the display drive method, adjusting the depth of the step over the pulse waveform of the gate voltage signal comprises:

Adjusting a number of square wave pulses in each clock cycle.

In some embodiments of the display drive method, the pixel-to-pixel charging variations can comprise at least one of row-to-row variations or column-to-column variations of the display panel corresponding to bright and dark stripes displayed on the display panel.

In a fourth aspect, the present disclosure provides a tangible, non-transitory, computer-readable storage medium. The computer-readable storage medium has instructions stored thereon, and is configured such that that, when executed by one or more processors, the instructions cause one or more processors to perform operations including: shaping a gate voltage signal to compensate for pixel-to-pixel charging variations to thereby reduce luminance variations on a display panel.

In some embodiments of the computer-readable storage medium, the shaping comprises forming a step over a pulse waveform of the gate voltage signal.

In some embodiments, the computer-readable storage medium can further include instructions stored thereon that, when executed by the one or more processors, cause the one or more processors to perform additional operations including:

Generating a first control signal;

Modulating a preset signal based on the first control signal to thereby generate a second control signal; and Shaping the gate voltage signal based on the second control signal prior to outputting the gate voltage signal.

Other embodiments, implementations, and advantages may become apparent in view of the following descriptions and the attached drawings.

BRIEF DESCRIPTION OF THE DRAWINGS

To more clearly illustrate the embodiments of the disclosure, the following is a brief description of the drawings, which are for illustrative purpose only. For those of ordinary skills in the art, other drawings of other embodiments can become apparent based on these drawings.

DETAILED DESCRIPTION

In the following, with reference to the drawings of various embodiments disclosed herein, the technical solutions of the embodiments of the disclosure will be described in a clear and fully understandable way.

It is obvious that the described embodiments are merely a portion but not all of the embodiments of the present disclosure. Based on the described embodiments of the disclosure, those ordinarily skilled in the art can obtain other embodiment(s), which come(s) within the scope sought for protection by the disclosure.

In liquid crystal displays (LCDs), due to the different configurations of the pixel electrode array and different types of polarity inversion, significant differences can exist for the charging effect among the pixels that are connected to different rows of gate scan lines.

Figure 1:
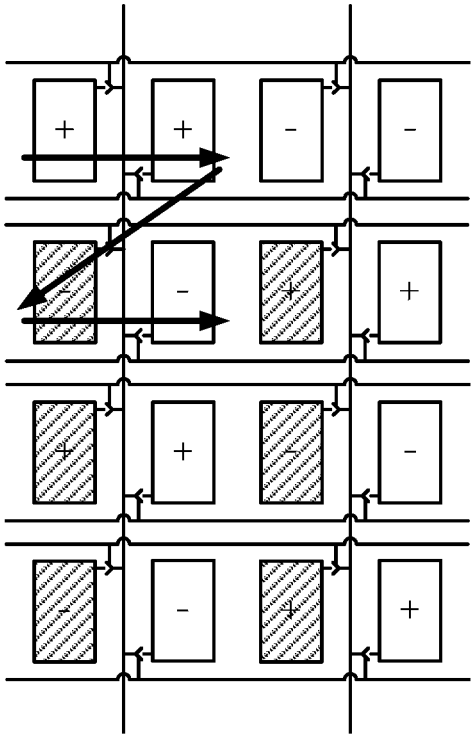
FIG. 1 is a schematic diagram of a Z reverse charging mode for a dual-gate architecture of a display drive circuit according to some embodiments.

FIG. 1 shows a dual-gate architecture of an LCD drive circuit. In a Z reverse charging mode, the charging polarities of the first column of data lines between the first two rows of pixels are respectively "+", "+", "−", and "−".

As the diagonal arrow in FIG. 1 indicates, when the charging polarity of the first column of the data line changes from "+" to "−", the large magnitude of the voltage amplitude and the parasitic capacitance on the data lines will result in a phase of transition from "+" polarity voltage to "−" polarity voltage for the first column of data line.

Because of this transition phase, the charging effect of the "−" polarity pixel on the second row and on the first column might not be able to reach a preset level within a given charging time, i.e., it may take a longer charging time to reach the preset level compared with other pixels.

As a result, the pixels in FIG. 1 marked with shadows may need longer charging time to reach the same charging effects as compared with other pixels. As such, in the situation where the charging time for each pixel is basically the same, these pixels can appear darker or brighter as a result of insufficient charging. These pixel-to-pixel charging variations can lead luminance variations across the display panel. Depending on the definition or orientation of "columns" or "rows" of pixels in a pixel array, alternating light stripes and dark stripes can appear on the display as brighter and darker rows or columns.

Various embodiments disclosed herein can realize shaping of a gate voltage signal to compensate for the pixel-to-pixel charging variations, to thereby reduce luminance variations on a display panel. The shaping can be achieved, for example, by shaping a step over a pulse waveform of the gate voltage signal. At least one of a width or a depth of the step over the pulse waveform of the gate voltage signal can be adjusted, using hardware and/or software programming.

In one aspect, the present disclosure provides a display drive circuit for driving a display panel having a plurality of pixels. The display drive circuit comprises a stepping unit, configured to shape a gate voltage signal to compensate for pixel-to-pixel charging variations to thereby reduce luminance variations on the display panel.

The display drive circuit can further include a time sequence control unit and a modulation unit. The time sequence control unit can be coupled to the modulation unit, and can be configured to generate a first control signal; and the modulation unit can be configured to utilize the first control signal to modulate a preset signal to thereby generate a second control signal; and the stepping unit can be coupled to the modulation unit, and can be configured to shape the gate voltage signal based on the second control signal prior to outputting the gate voltage signal.

In some embodiments of the display drive circuit, the preset signal can include at least one of a step depth signal and a step width signal. The first control signal can comprise at least one of a depth modulation signal and a width modulation signal, wherein the modulation unit can be configured to utilize the depth modulation signal to modulate the step depth signal, and to utilize the width modulation signal to modulate the step width signal. The second control signal can comprise at least one of a modulated step depth signal and a modulated step width signal.

Figure 2:
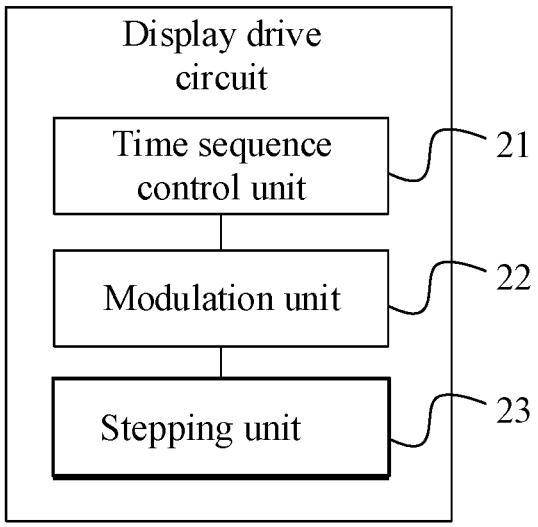
FIG. 2 is a block diagram of a display drive circuit according to some embodiments.

FIG. 2 is a block diagram of a display drive circuit according to some embodiments. As shown in FIG. 2, the display drive circuit comprises a time sequence control unit 21, a modulation unit 22, and a stepping unit 23. The time sequence control unit 21 can be realized using, for example, a processing circuit including transistors, a processor, instructions executable by a processor, etc.

The modulation unit 22 can be realized using, for example, a processing circuit including transistors, a processor, instructions executable by a processor, etc.

The stepping unit 23 can be a waveform or pulse shaping unit realized using, for example, a processing circuit including transistors, a processor, instructions executable by a processor, etc.

The various units as described above can be realized using discrete components, shared circuits, or instructions according to some embodiments. There are no limitations herein.

Figure 3:
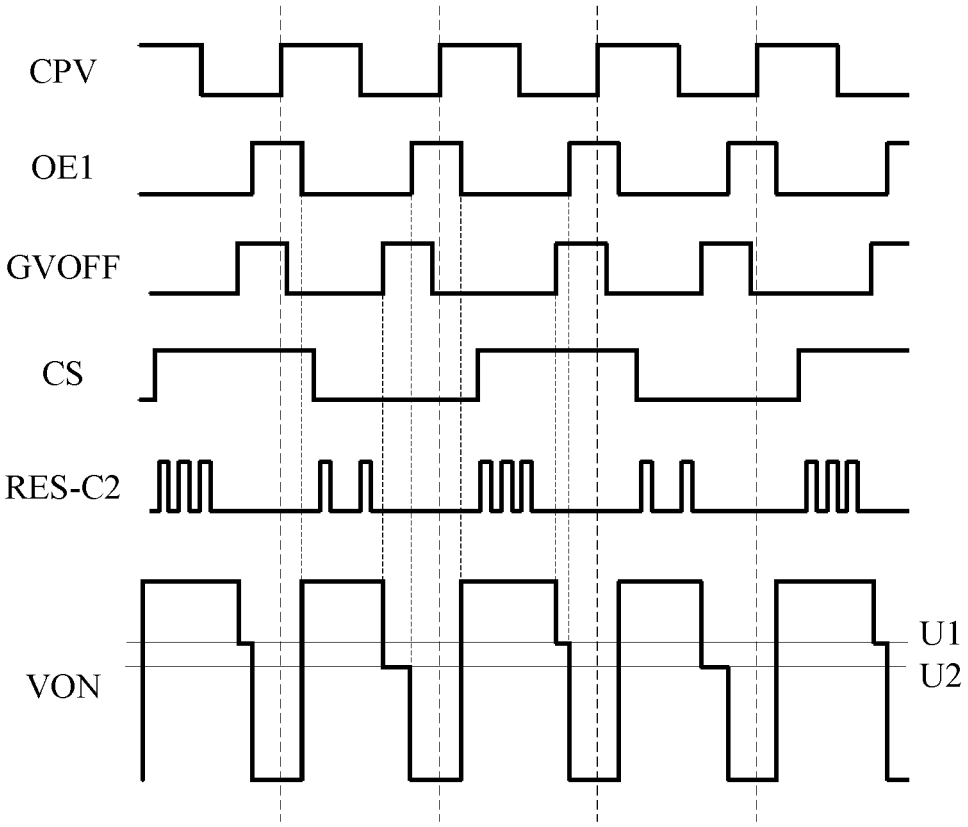
FIG. 3 is a working sequence diagram of a display drive circuit according to some embodiments.
Figure 4:
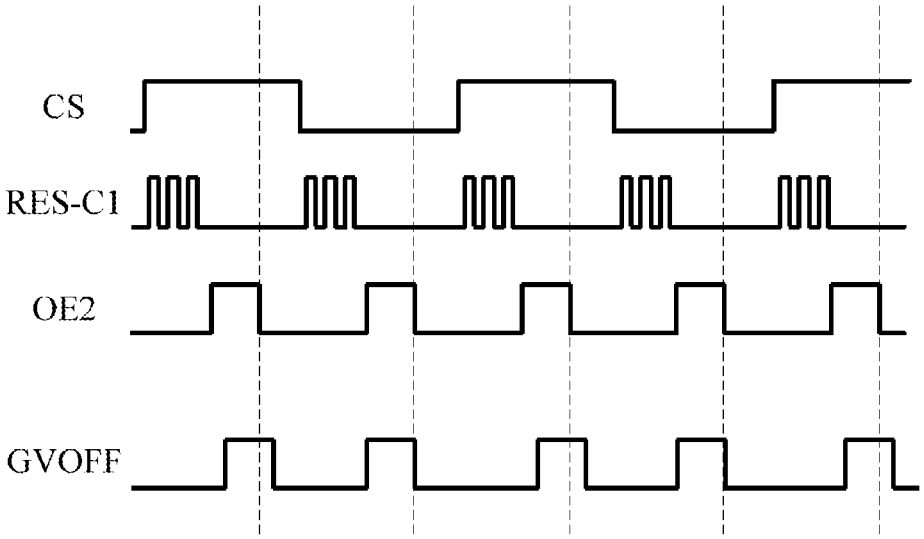
FIG. 4 is a diagram illustrating the principles for modulating the step width signal of a display drive circuit according to some embodiments.

With reference also to FIGS. 3 and 4, the preset signal can include a step width signal OE2, and a step depth signal AVDD based on a preset clock signal CPV. The time sequence control unit 21 can be coupled to the modulation unit 22, and can be configured to generate a first control signal, which includes a width modulation signal RES-C1, and/or a depth modulation signal RES-C2.

The time sequence control unit 21 can have a timing controller (TCON) architecture as employed in current display devices according to some embodiments. If the preset clock signal is the same, the step width signal OE2, the step depth signal AVDD, the width modulation signal RES-C1, and/or the depth modulation signal RES-C2 of any waveforms can be generated.

The modulation unit 22 can be coupled to the stepping unit 23, and configured to utilize the first control signal to modulate the preset signal to thereby generate the second control signal. Depending on the specific form of the second control signal and the first control signal, the modulation unit 22 can modulate the step width signal OE2 and/or the step depth signal AVDD, so as to realize a degree of stepping as specified by the second control signal. For example, a bleeder circuit or a transformer circuit can be employed to modulate the voltage amplitude, and a delay circuit can be employed to modulate the time sequence of the signals, etc.

The stepping unit 203 can be configured to "chamfer," e.g., cause a step in the waveform of, the gate voltage signal VON, according to the second control signal generated by the modulation unit 22, before outputting the gate voltage signal VON. The second control signal can include the modulated step width signal GVOFF, and/or the modulated step depth signal THR.

In some embodiments, the "before outputting the gate voltage signal VON" includes any time points between the gate voltage signal VON is generated and outputted.

It can be understood that the gate voltage signal VON is configured to provide a voltage signal to progressively turn on each of the transistors coupled to a plurality of rows of gate scan lines. ON and OFF of the pixel electrodes in LCDs during the charging process in each display frame are controlled by ON and OFF of theses transistors.

As such, chamfering (e.g., forming a step at the waveform) of the gate voltage signal VON can be realized from the aspects of step depth and step width, can be employed to adjust the extent of the charging of the pixel electrodes that correspond to each row of gate scan line in a row-by-row and small-amplitude manner.

It can be understood that the specific circuit implementation methods for chamfering (or stepping) of the gate voltage signal can employ those current methods that are known to those skilled in the art, such as conventional waveform shaping circuits. There are on limitations herein.

In some embodiments, the time sequence control unit can generate the first control signal for modulating the amplitude of stepping. Accordingly, the modulation unit can modulate the amplitude of stepping based on the first control signal, and the stepping unit outputs the gate voltage signals, after stepping, to the scan drive circuit. As such, the modulation at a preset amplitude of stepping can be realized at the gate scan lines.

The second control signal can be configured in a number of different ways, such as through a circuit, or via software programming. As such, modulating to a preset degree the stepping of gate voltage signals can be realized any of the plurality of rows of gate scan lines.

For example, in the drive circuit illustrated in FIG. 1, the pixels marked with shadow need longer charging times to reach the same charging effects compared with other pixels. Therefore, in a conventional charging mode, there are situations where the light emitted is darker or brighter because of insufficient charging under the situation where the charging time is substantially the same for each pixel, resulting in alternate light stripes and dark stripes on displays.

According to some embodiments disclosed herein, by reducing the degree of stepping of the gate voltage signals on the gate scan lines that correspond to all the pixels marked with shadows, the charging time of these pixels can be compensated, resulting in a same charging effect for the pixels.

As such, various embodiments disclosed herein can be employed to solve the issue of significant differences in charging effects among pixels coupled to different rows of gate scan lines, making it possible to adjust the charging effects of pixels in the display apparatuses even after they are manufactured. This can significantly improve the display effects, and reduce the costs associated with testing and maintenance.

Because adjustment of the degree of charging can be achieved by modulation of either the step depth or the step width, according to some embodiments, any one of, or a combination of, the step depth or the step width can be selected for modulation, to thereby solve the issue of significant differences in the charging effects of pixels coupled to different rows of the gate scan lines.

In one example, FIG. 3 illustrates a working sequence diagram of a display drive circuit according some embodiments of the present disclosure. As shown in FIG. 3, under the calibration of the preset clock signal CPV, the gate control signal OE1 and the modulated step width signal GVOFF can respectively determine the location of each rising edge and falling edge of the gate voltage signal VON.

As shown by the short-dashed lines in FIG. 3, after being trigged by the falling edge of the gate control signal OE1, the gate voltage signal changes from the lowest electric potential to the highest electric potential; and after being triggered by the rising edge of the gate control signal OE1, the gate voltage signal changes from the highest electric potential to the lowest electric potential.

In addition, after being triggered by the rising edge of the modulated step width signal GVOFF, the electrode drive signal VON starts to be chamfered. Thus, for any rows of the gate scan lines, the distance between the rising edge of the modulated step width signal GVOFF and the rising edge of the gate control signal OE1 determines the stepping width of the corresponding gate voltage signal VON.

It can be understood that, if the rising edge of the modulated step width signal GVOFF in any clock cycle is adjusted forward or backward (e.g., moved to the left or right on the timeline), the step width of the gate voltage signal VON in this clock cycle will be lengthened or shortened accordingly.

In some embodiments, the different numbers of square wave pulses of the depth modulation signal RES-C2 in each different clock cycle can modulate the amplitude of the step depth signal AVDD, so as to obtain the modulated step depth signal THR. As such, the level of the electric potential can be provided by the modulated step depth signal THR during the stepping period of the gate voltage signal VON.

As shown in FIG. 3, the electric potential of the gate voltage signal VON corresponding to three square wave pulses is U1, and the electric potential of the gate voltage signal VON corresponding to two square wave pulses is U2. The step depths are different in these different cases.

The time sequence control unit 21 can be employed to generate the depth modulation signal RES-C2 with a preset number of square wave pulses in each clock cycle, thereby realizing the adjustment of the step depth of the gate voltage signal VON in each clock cycle, and in turn achieving the configuration of the level of charging of the pixel electrodes corresponding to each row of gate scan lines.

In some embodiments, the row selection signal CS in FIG. 3 can be generated by the time sequence control unit 21, and can be configured to control the effectiveness of the modulation unit 22 in each clock cycle.

For example, the row selection signal CS can specifically affect the width modulation signal RES-C1 and the depth modulation signal RES-C2, such that within the several time periods when the row selection CS is at a high electric potential, both of the width modulation signal RES-C1 and the depth modulation signal RES-C2 have default waveforms (for example, RES-C2 has three square wave pulses within these periods).

Alternatively, the row selection signal CS can also effect during the period when the first control signal is being modulated. For example, during the period when the row selection signal CS is at an effective electric potential, the modulation unit 22 does not modulate one or two signals of the first control signal. The effective electric potential can be one of the high electric potential or the low electric potential, and specific voltage ranges of the high electric potential and the low electric potential can be determined based on specific needs.

Therefore, under the action of the row selection signal CS, which can have any waveforms as programmed through a hardware circuit or software, the freedom and reliability in configuration of the level of charging can be improved. During the modulation process in which the row selection signal CS is applied to the first control signal, the working time of the modulation unit 22 can be reduced, thereby lowering the power consumption and enhancing the response speed.

FIG. 4 is a diagram illustrating the modulation principles of a display drive circuit according to some embodiments. As shown in FIG. 4, the depth modulation signal RES-C2 has three square wave pulses in each clock cycle. Under the effect of the row selection signal CS, the modulation unit 22 adjusts backward the phase of the step width signal OE2 in the clock cycle only during periods when the row selection signal CS is at the high electric potential of the effective electric potential.

The magnitude of backward adjustment is determined by the number of square wave pulses of the depth modulation signal RES-C2 in this clock cycle. Depending on the different specific needs, the forward adjustment can also be included in the overall adjustment range.

It can be understood that based on the input and output relationships represented by the waveforms of each of the signals in FIG. 4, the modulation unit 22 can have corresponding circuit structures.

Figure 5:
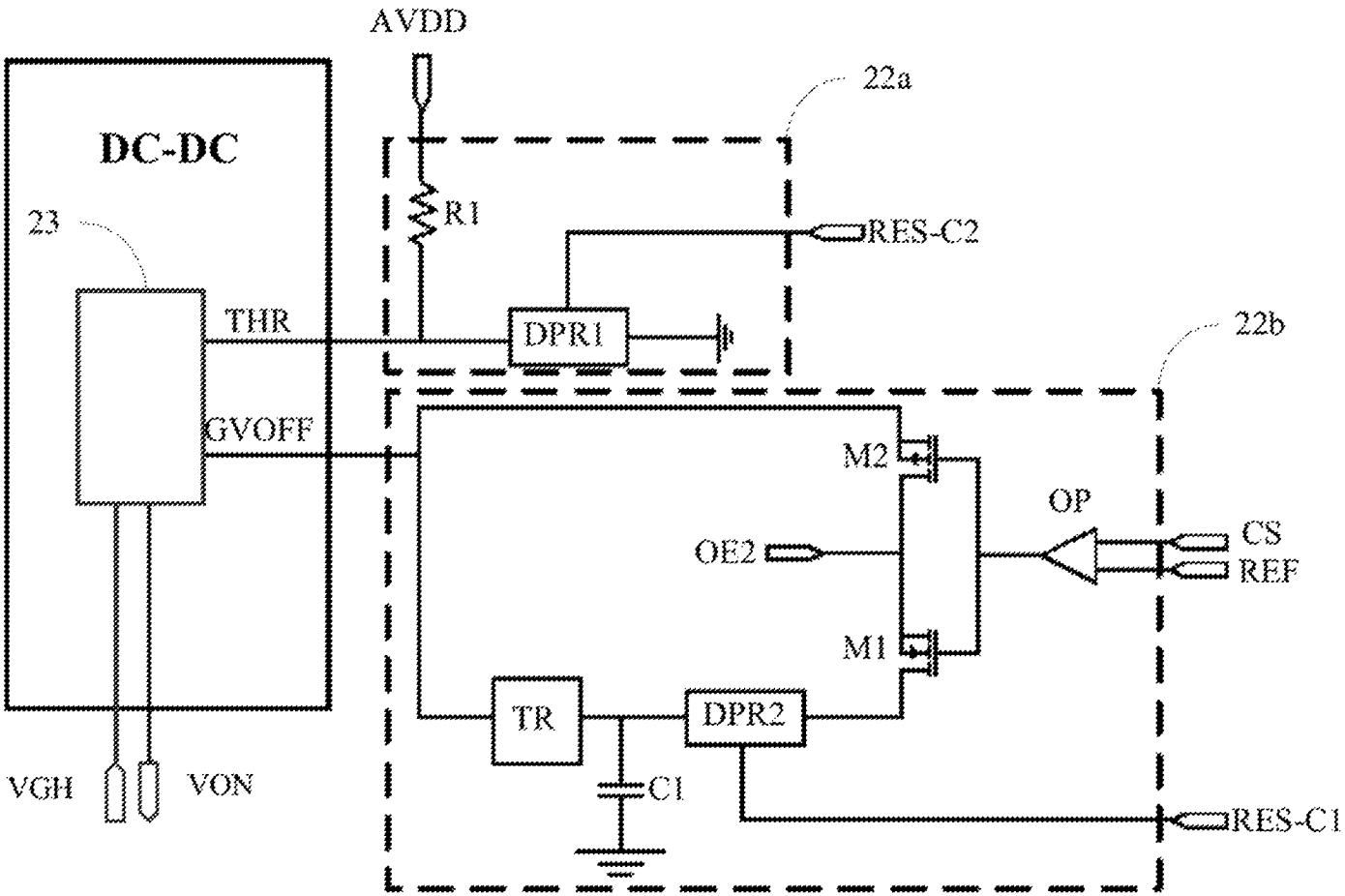
FIG. 5 is a circuit structure diagram of a modulation unit of a display drive circuit according to some embodiments.

FIG. 5 illustrates a circuit structure diagram of a modulation unit of a display drive circuit according to some embodiments of the present disclosure. As shown in FIG. 5, the modulation unit includes a depth modulation unit 22*a*, and a width modulation module 22*b*.

The depth modulation module 22*a* can be configured to modulate the amplitude of the step depth signal AVDD based on the depth modulation signal REC-C2, so as to form the aforementioned modulated step depth signal THR. Specifically, the depth modulation module 22*a* can include a control terminal (e.g., the upper end in FIG. 5) and a first digital rheostat DPR1; and the first digital rheostat DPR1 is coupled to a terminal for the depth modulation signal.

In addition, a first terminal of the first digital rheostat DPR1 (the right end in FIG. 5) is coupled to a common terminal; a second terminal of the first digital rheostat DPR1 (the left end in FIG. 5) is coupled to the stepping unit 23, and the first digital rheostat DPR1 is coupled to a terminal for the step depth signal AVDD through a first resistor R1.

In terms of functionality, under the situation where the depth modulation signal RES-C2 includes a preset number of square wave pulses (as shown in FIG. 3) in each clock cycle, the first digital rheostat DPR1 is configured to determine the resistance between the first terminal and the second terminal based on the number of square wave pulses received by the control terminal in each clock cycle.

As such, under the partial voltage between the first digital rheostat DPR1 and the first resistor R1, the downward-amplitude modulation of the step depth signal AVDD under the control of the depth modulation signal REC-C2 can be realized, thus achieving the modulation of the step depth as illustrated in FIG. 3.

In some embodiments, the width modulation module 22*b* can be configured to adjust forward or backward the phase of the step width signal OE2 when each row selection signal CS is at the effective electric potential according to the width modulation signal RES-C1, thereby achieving the inputs and outputs represented by the waveforms of each individual signal as shown in FIG. 4.

In some embodiments, the width modulation module 22*b* in FIG. 5 includes an operational amplifier OP, a first transistor M1, a second transistor M2, a second digital rheostat R2, a first capacitor C1, and a trigger TR.

The non-inverting terminal and the inverting terminal of the operational amplifier OP are respectively coupled to one of a terminal for the row selection signal CS or a terminal for the preset off-set voltage REF, and the output terminal is coupled to the gate of the first transistor M1 and the gate of the second transistor M2.

In addition, the first transistor M1 and the second transistor M2 are respectively one of a P-type transistor or an N-type transistor. In this configuration, the operational amplifier OP can control the ON and OFF of the first transistor M1 and the second transistor M2 via the differential signal between the outputted row selection signal and the preset off-set voltage REF.

In addition, because the first transistor and the second transistor are respectively one of a P-type transistor or an N-type transistor, there is always one ON and another one OFF.

It can be understood that the electric potential of the preset off-set voltage REF and the specific type of the first transistor M1 and the second transistor M2 are determined by whether the effective electric potential of the row selection signal CS is the high electric potential or the low electric potential.

One of the source electrode or the drain electrode of the first transistor M1 is coupled to a terminal for the step width signal OE2, and the other one is coupled to the first terminal of the second rheostat DPR2 (the right end in FIG. 5).

In the example as shown in FIG. 5, the first transistor M1 is an N-type transistor, for example, therefore it will be ON when the operational amplifier OP outputs a high electric potential. The electrode coupled to the terminal for the step width signal OE2 is, for example, the drain electrode of the first transistor M1. The electrode coupled to the first terminal of the second digital rheostat DPR 2 is, for example, the source electrode of the first transistor M1.

One of the source electrode or the drain electrode of the second transistor M2 is coupled to a terminal for the step width signal OE2, and the other one is coupled to the stepping unit 23 so as to output the aforementioned modulated step width signal GVOFF.

In the example as shown in FIG. 5, the second transistor M2 can be a P-type transistor, therefore it will be ON if the operational amplifier OP outputs a low electric potential. The electrode coupled to the terminal for the step width signal OE2 can be the drain electrode of the second transistor M2. The electrode coupled to the first terminal of the stepping unit 23 can be the source electrode of the second transistor M2.

The turn-on of the second transistor M2 can directly conduct the voltage of the step width signal OE2 to the stepping unit 23, which thus serves as a portion of the modulated step width signal GVOFF, which is consistent with the waveform as shown in FIG. 4.

In some embodiments of the display drive circuit, the control terminal of the second digital rheostat DPR2 (the lower end in FIG. 5) is coupled to a terminal for the width modulation signal RES-C1; the second terminal of the second digital rheostat DPR2 (the left end in FIG. 5) is coupled to the input terminal of the trigger TR, and is further coupled to the common terminal through the two terminals of the first capacitor C1.

The output terminal of the trigger TR is coupled to the stepping unit 23, and is configured to output a high electric potential if the electric potential at the input terminal is higher than the preset electric potential.

In the situation where the width modulation signal RES-C1 includes a preset number of square wave pulses in each clock cycle (e.g., as shown in FIG. 4), the second digital rheostat DPR2 can determine the resistance between the first terminal and the second terminal according to the number of square wave pulses received by the control terminal within each clock cycle.

Thus, the second digital rheostat DPR2 whose resistance is controlled by the width modulation signal RES-C1, the first capacitor C1, and the trigger TR form an RC delay circuit. For example, the RC circuit formed by the second digital rheostat DPR2 and the first capacitor C1 can gradually increase the voltage at the input terminal of the trigger TR according to the corresponding level of the product of the resistance value and the capacitance value, at the rising edge of the step width signal OE2 if the first transistor is turned on.

The trigger TR outputs a low electric potential if the electric potential at the input terminal of the trigger TR is not higher than the aforementioned preset electric potential, and outputs a high electric potential to achieve the delay of the falling edge if the electric potential at the input terminal of the trigger TR is higher than the aforementioned preset electric potential.

Based on the same principle, at the falling edge of the step width signal OE2, this RC circuit can achieve the delay of the falling edge. Thus, the magnitude of the signal delay can be adjusted by varying the resistance of the second digital rheostat DPR2 through the width modulation signal RES-C1, thereby achieving the adjustment of the step width as shown in FIG. 4.

In FIG. 5, the stepping unit 23 can be arranged in a DC output circuit (DC-DC), and can be realized by adding and/or multiplexing circuit structures. In some embodiments, the circuit structure of any portion of the aforementioned display drive circuit can be replaced with a circuit structure having a same signal input-output relationship, for example, with a digital signal processor (DSP) loaded with corresponding digital signal processing programs, a field-programmable gate array (FPGA), a processing circuit, an application-specific integrated circuit (ASIC), or other hardware or software.

Figure 6:
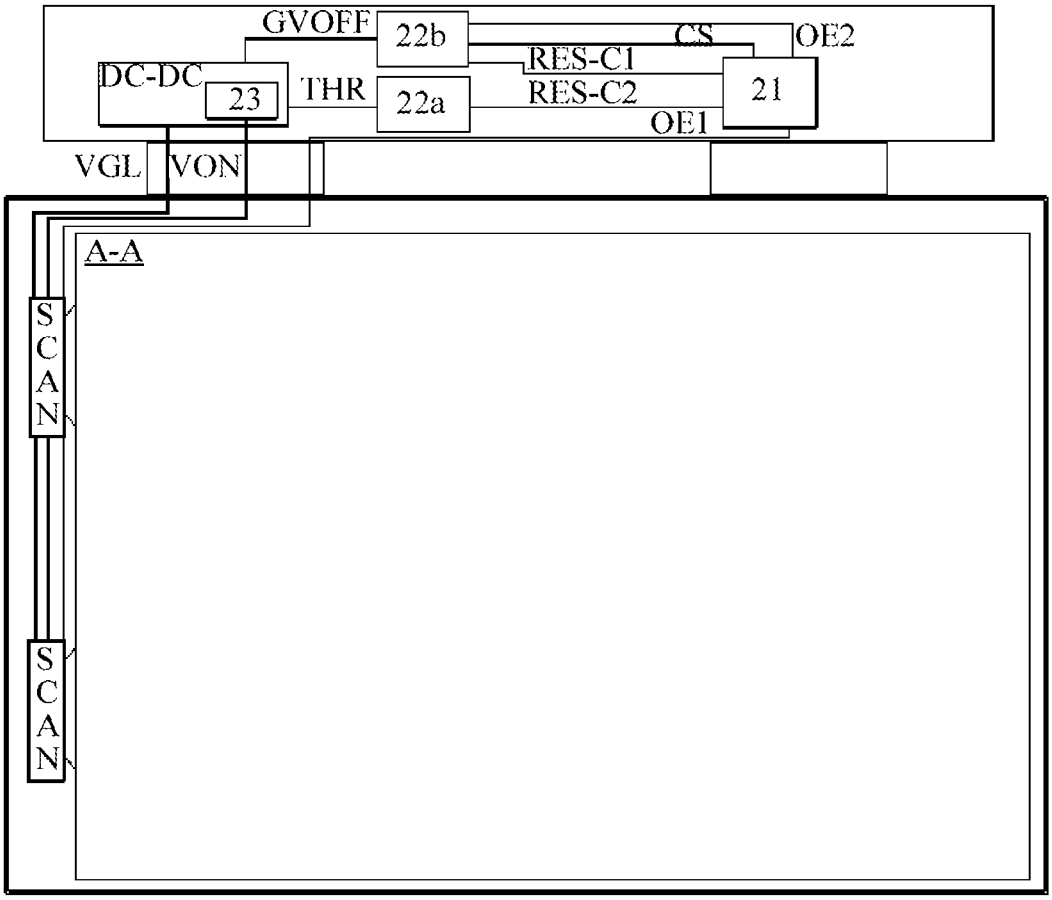
FIG. 6 is a schematic diagram of the position configuration of a display drive circuit according to some embodiments.

FIG. 6 is a schematic diagram of a position configuration of the display drive circuit according to some embodiments of the present disclosure. For example, FIG. 6 shows a display area A-A of a display panel and a display drive circuit arranged at the surrounding area of the display area A-A.

Specifically, the display drive circuit can a gate scan drive circuit SCAN, arranged at one side of the display area A-A of the display panel, and the gate scan drive circuit can be directly coupled to the abovementioned plurality of rows of gate scan lines so as to provide gate voltage signals to each row of gate scan lines according to the gate low electric potential signal VGL and the gate voltage signal VON.

The display drive circuit can further comprise a time sequence drive unit 21, which can be, or as part of, a time sequence control circuit. The display drive circuit can further include a depth modulation module 22*a*, a width modulation module 22*b*, and a stepping unit 23 that can be configured in the DC output circuit. These portions of the display drive circuit can be arranged over a flexible circuit board mounted on one side of the display panel. The display drive circuit can also include a data drive circuit not shown in the drawings.

As can be seen, except that the time sequence drive circuit 21 also provides the gate control signal OE1 to the gate scan drive circuit SCAN, the signal transmission relationships as shown in FIG. 6 are consistent with those described earlier in this disclosure.

With respect to the configuration relationships, it should be noted that one or both of the depth modulation module 22*a* and the width modulation module 22*b* may be arranged in a time sequence control circuit (TCON), in a DC output circuit (DC-DC), or between the time sequence control circuit and the DC output circuit as a stand-alone circuit.

In a second aspect, the present disclosure also provides a display apparatus, which comprises a display drive circuit according to any of the embodiments as described above. It should be noted that the display apparatus can be a display panel, an electronic paper, a mobile phone, a tablet computer, a television, a notebook computer, a digital picture frame, a navigation system, or any other products or components having a display function.

As shown in FIG. 6, the display apparatus can include a scan drive circuit, which is coupled to a stepping unit and is configured to receive gate voltage signals from the stepping unit.

The display apparatus disclosed herein can compensate for the significant differences in charging effects among pixels that are coupled to different rows of gate scan lines in current technologies, making it possible to adjust the charging effects of pixels in the display devices after manufacturing. This can be beneficial to the enhancement of display effects, and the reduction of the costs associated with testing and maintenance.

In a third aspect, the present disclosure further provides a display drive method. The display drive method comprises a step of shaping a gate voltage signal to compensate for pixel-to-pixel charging variations to thereby reduce luminance variations on a display panel.

In some embodiments of the display drive method, the step of shaping a gate voltage signal can comprise the following three sub-steps:

(1) generating a first control signal;

(2) modulating a preset signal based on the first control signal to thereby generate a second control signal; and (3) shaping the gate voltage signal based on the second control signal prior to outputting the gate voltage signal.

In some of the embodiments of the display drive method, the sub-step of shaping the gate voltage signal can comprise: shaping a step over a pulse waveform of the gate voltage signal, which can comprise at least one of: adjusting a width of the step over the pulse waveform of the gate voltage signal; and adjusting a depth of the step over the pulse waveform of the gate voltage signal.

In some embodiments of the display drive method, the preset signal can comprise at least one of a step depth signal and a step width signal, and accordingly, the first control signal can comprise at least one of a depth modulation signal and a width modulation signal; and the second control signal comprises at least one of a modulated step depth signal and a modulated step width signal.

Figure 7:
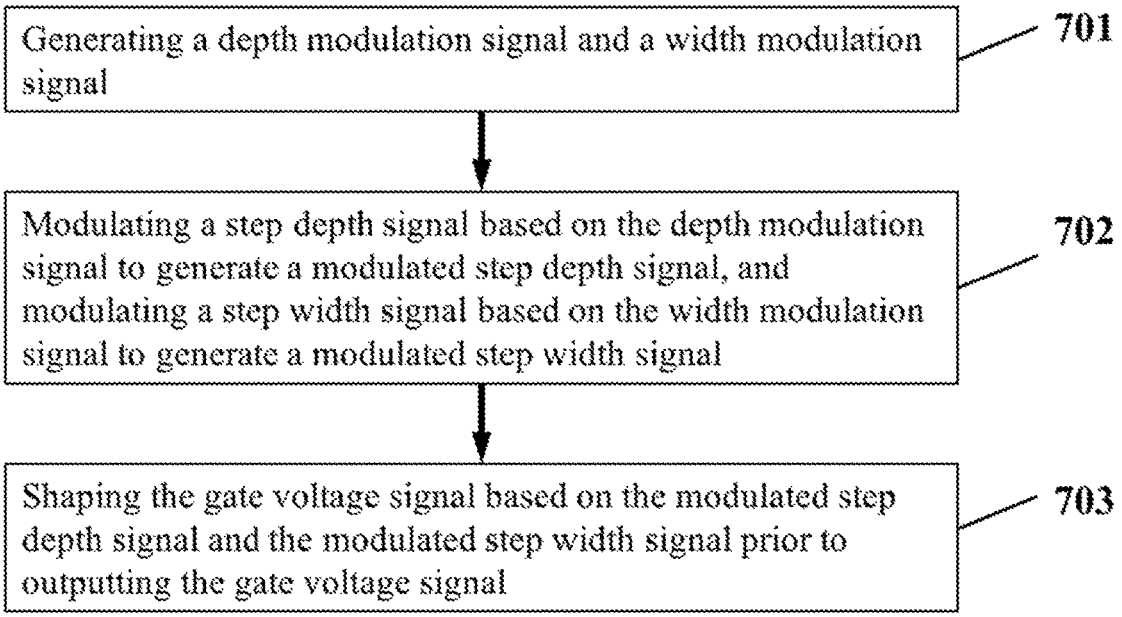
FIG. 7 is a flow chart of a display drive method according to some embodiments of the present disclosure.

FIG. 7 illustrates a flow chart of a display drive method according to some embodiments as described above, which specifically comprises the following three sub-steps:

Step 701: generating a depth modulation signal and a width modulation signal;

Step 702: Modulating a step depth signal based on the depth modulation signal to thereby generate a modulated step depth signal, and modulating a step width signal based on the width modulation signal to thereby generate a modulated step width signal;

Step 703: Shaping the gate voltage signal based on the modulated step depth signal and the modulated step width signal prior to outputting the gate voltage signal.

The steps can be executed with hardware and/or software. For example, the display drive circuits described above, or any equivalent circuit structures, such as realized using a DSP, an FPGA, or an ASIC, can be employed to implement the drive method. The display drive method provided by the present disclosure can solve the issues resulting from the significant differences in charging effects among pixels connected to different rows of gate scan lines in conventional technologies, making it possible to adjust the charging effects of pixels in the display devices after manufacturing, which is beneficial to the enhancement of display effects and to the reduction of costs associated with subsequent testing and maintenance.

It should be noted that orientation or positional relationship as indicated by the term "up," "down," etc. are orientation or positional relationships based on the drawings, and the descriptions in the disclosure do not indicate or imply that the devices or elements referred to must have a particular orientation, or they must be constructed or operated with particular orientation, and therefore these relative terms cannot be construed as limiting the present disclosure.

Unless otherwise clearly defined and limited, the term "mounted," "connected," "coupled," "connection" should be broadly interpreted. For example, they may be a fixed connection, a removable connection, or an integral connection. They may be a mechanical connection, or an electrical connection. Such connections may be direct connections, connections through intermediaries, or internal connections of two or more components or portions.

Those of ordinary skill in the art will recognize that the functional blocks, methods, devices, and systems described in the present disclosure may be integrated or divided into different combinations of systems, devices, and functional blocks. Any suitable programming languages and programming techniques may be used to implement the routines of particular embodiments.

Different programming techniques may be employed such as procedural or object-oriented. The routines may execute on a single processing device or multiple processors. Although the steps, operations, or computations may be presented in a specific order, the order may be changed in different particular embodiments. In some particular embodiments, multiple steps shown as sequential in this specification may be performed at the same time.

A "processor" includes any suitable hardware and/or software system, mechanism or component that processes data, signals or other information. A processor may include a system with a general-purpose central processing unit, multiple processing units, dedicated circuitry for achieving functionality, or other systems.

Processing need not be limited to a geographic location, or have temporal limitations. For example, a processor may perform its functions in "real-time," "offline," in a "batch mode," etc. Portions of processing may be performed at different times and at different locations, by different (or the same) processing systems.

Various embodiments disclosed herein can be realized via hardware and/or software, such a computer program stored on a memory. For example, a tangible, non-transitory, computer-readable storage medium having instructions stored thereon that, when executed by one or more processors, cause the one or more processors to perform operations including the steps described above.

The memory or storage medium may be any suitable data storage, memory and/or non-transitory computer-readable storage medium, including electronic storage devices such as random-access memory (RAM), read-only memory (ROM), magnetic storage device (hard disk drive or the like), flash, optical storage device (CD, DVD or the like), magnetic or optical disk, or other tangible media such as non-transitory computer-readable medium suitable for storing instructions for execution by the processor.

The software instructions can also be contained in, and provided as, an electronic signal, for example in the form of software as a service (SaaS) delivered from a server (e.g., a distributed system and/or a cloud computing system).

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A display drive circuit for driving a display panel having a plurality of pixels, comprising:

a stepping unit, configured to shape a gate voltage signal to compensate for pixel-to-pixel charging variations to thereby reduce luminance variations on the display panel;

a time sequence control unit; and a modulation unit, wherein:

the time sequence control unit is coupled to the modulation unit, and is configured to generate a first control signal;

the modulation unit is configured to utilize the first control signal to modulate a preset signal to thereby generate a second control signal;

the stepping unit is coupled to the modulation unit, and is configured to shape the gate voltage signal based on the second control signal prior to outputting the gate voltage signal;

the width modulation module is configured to adjust forward or backward a phase of the step width signal in each time period when the row selection signal is an effective voltage potential according to the width modulation signal;

the stepping unit is configured to shape at least one of a width and a depth of a step over a pulse waveform of the gate voltage signal;

the preset signal comprises at least one of a step depth signal and a step width signal;

the first control signal comprises at least one of a depth modulation signal and a width modulation signal;

the modulation unit is configured to utilize the depth modulation signal to modulate the step depth signal, and to utilize the width modulation signal to modulate the step width signal;

the second control signal comprises at least one of a modulated step depth signal and a modulated step width signal;

the modulation unit comprises at least one of:

a depth modulation module, configured to adjust an amplitude of the step depth signal based on the depth modulation signal; or a width modulation module, configured to adjust an amplitude of the step width signal based on the width modulation signal; and the width modulation module is configured to adjust forward or backward a phase of the step width signal in each time period when the row selection signal is an effective voltage potential according to the width modulation signal.

2. The display drive circuit of claim 1, wherein the time sequence control unit is configured to additionally generate a row selection signal, wherein the row selection signal is configured to control effectiveness of the modulation unit in each clock cycle.

3. The display drive circuit of claim 1, wherein the width modulation module comprises an operational amplifier, a first transistor, a second transistor, a second digital rheostat, a first capacitor, and a trigger, wherein:

a non-inverting terminal and an inverting terminal of the operational amplifier are respectively coupled to a terminal for the row selection signal and a terminal for a preset off-set voltage, an output terminal of the operational amplifier is coupled to a gate of the first transistor and a gate of the second transistor;

the first transistor and the second transistor comprise at least one of a P-type transistor or an N-type transistor;

one of a source electrode or a drain electrode of the first transistor is coupled to a terminal for the step width signal, and another one of the source electrode or the drain electrode of the first transistor is coupled to a first terminal of the second digital rheostat;

one of a source electrode or a drain electrode of the second transistor is coupled to the terminal for the step width signal, and another one of the source electrode or the drain electrode of the second transistor is coupled to the stepping unit;

a control terminal of the second digital rheostat is coupled to a terminal for the width modulation signal; a second terminal of the second digital rheostat is coupled to an input terminal of the trigger, and is coupled to the common terminal via two terminals of the first capacitor; and an output terminal of the trigger is coupled to the stepping unit, and is configured to output a high electric potential if the input terminal of the trigger is higher than a preset electric potential.

4. The display drive circuit of claim 3, wherein the width modulation signal comprises a preset number of square wave pulses in each clock cycle, and the second digital rheostat is configured to determine a resistance between the first terminal and the second terminal according to a number of square wave pulses received by the control terminal in each clock cycle.

5. The display drive circuit of claim 1, wherein a width of a step of the gate voltage signal is determined by a distance between a rising edge of the modulated step width signal and a rising edge of a gate control signal.

6. A display apparatus, comprising the display drive circuit according to claim 1.

7. The display apparatus of claim 6, further comprising a scan drive circuit, coupled to the stepping unit and configured to receive the gate voltage signal from the stepping unit.

8. A display drive circuit for driving a display panel having a plurality of pixels, comprising:

a stepping unit, configured to shape a gate voltage signal to compensate for pixel-to-pixel charging variations to thereby reduce luminance variations on the display panel;

a time sequence control unit; and a modulation unit, wherein:

the time sequence control unit is coupled to the modulation unit, and is configured to generate a first control signal;

the modulation unit is configured to utilize the first control signal to modulate a preset signal to thereby generate a second control signal;

the stepping unit is coupled to the modulation unit, and is configured to shape the gate voltage signal based on the second control signal prior to outputting the gate voltage signal;

the stepping unit is configured to shape at least one of a width and a depth of a step over a pulse waveform of the gate voltage signal;

the preset signal comprises at least one of a step depth signal and a step width signal;

the first control signal comprises at least one of a depth modulation signal and a width modulation signal;

the modulation unit is configured to utilize the depth modulation signal to modulate the step depth signal, and to utilize the width modulation signal to modulate the step width signal;

the second control signal comprises at least one of a modulated step depth signal and a modulated step width signal the modulation unit comprises at least one of:

a depth modulation module, configured to adjust an amplitude of the step depth signal based on the depth modulation signal; or a width modulation module, configured to adjust an amplitude of the step width signal based on the width modulation signal;

the depth modulation module comprises a first digital rheostat;

a control terminal of the first digital rheostat is coupled to a terminal for the depth modulation signal;

a first terminal of the first digital rheostat is coupled to a common terminal; and a second terminal of the first digital rheostat is coupled to the stepping unit, and is coupled to a terminal for the step depth signal via a first resistor.

9. The display drive circuit of claim 8, wherein the depth modulation signal comprises a preset number of square wave pulses in each clock cycle, and the first digital rheostat is configured to determine a resistance between the first terminal and the second terminal according to a number of square wave pulses received by the control terminal in each clock cycle.

10. A display drive method for driving a display panel having a plurality of pixels with a display drive circuit, the method comprising:

shaping a gate voltage signal to compensate for pixel-to-pixel charging variations to thereby reduce luminance variations on a display panel;

wherein the display drive circuit comprises:

a stepping unit, configured to shape a gate voltage signal to compensate for pixel-to-pixel charging variations to thereby reduce luminance variations on the display panel;

a time sequence control unit; and a modulation unit, wherein:

the time sequence control unit is coupled to the modulation unit, and is configured to generate a first control signal;

the modulation unit is configured to utilize the first control signal to modulate a preset signal to thereby generate a second control signal;

the stepping unit is coupled to the modulation unit, and is configured to shape the gate voltage signal based on the second control signal prior to outputting the gate voltage signal;

the stepping unit is configured to shape at least one of a width and a depth of a step over a pulse waveform of the gate voltage signal;

the preset signal comprises at least one of a step depth signal and a step width signal;

the first control signal comprises at least one of a depth modulation signal and a width modulation signal;

the modulation unit is configured to utilize the depth modulation signal to modulate the step depth signal, and to utilize the width modulation signal to modulate the step width signal;

the second control signal comprises at least one of a modulated step depth signal and a modulated step width signal the modulation unit comprises at least one of:

a depth modulation module, configured to adjust an amplitude of the step depth signal based on the depth modulation signal; or a width modulation module, configured to adjust an amplitude of the step width signal based on the width modulation signal;

the width modulation module comprises an operational amplifier, a first transistor, a second transistor, a second digital rheostat, a first capacitor, and a trigger, wherein:

a non-inverting terminal and an inverting terminal of the operational amplifier are respectively coupled to a terminal for the row selection signal and a terminal for a preset off-set voltage, an output terminal of the operational amplifier is coupled to a gate of the first transistor and a gate of the second transistor;

the first transistor and the second transistor comprise at least one of a P-type transistor or an N-type transistor;

one of a source electrode or a drain electrode of the first transistor is coupled to a terminal for the step width signal, and another one of the source electrode or the drain electrode of the first transistor is coupled to a first terminal of the second digital rheostat;

one of a source electrode or a drain electrode of the second transistor is coupled to the terminal for the step width signal, and another one of the source electrode or the drain electrode of the second transistor is coupled to the stepping unit;

a control terminal of the second digital rheostat is coupled to a terminal for the width modulation signal;

a second terminal of the second digital rheostat is coupled to an input terminal of the trigger, and is coupled to the common terminal via two terminals of the first capacitor; and an output terminal of the trigger is coupled to the stepping unit, and is configured to output a high electric potential if the input terminal of the trigger is higher than a preset electric potential.

11. The display drive method of claim 10, wherein shaping a gate voltage signal comprises:

generating a first control signal;

modulating a preset signal based on the first control signal to thereby generate a second control signal; and shaping the gate voltage signal based on the second control signal prior to outputting the gate voltage signal.

12. The display drive method of claim 11, wherein shaping the gate voltage signal comprises:

shaping a step over a pulse waveform of the gate voltage signal.

13. The display drive method of claim 12, wherein shaping a step over a pulse waveform of the gate voltage signal comprises at least one of:

adjusting a width of the step over the pulse waveform of the gate voltage signal; and adjusting a depth of the step over the pulse waveform of the gate voltage signal.

14. The display drive method of claim 13, wherein the preset signal comprises at least one of a step depth signal and a step width signal, wherein:

generating a first control signal comprises generating at least one of a depth modulation signal and a width modulation signal;

modulating a preset signal based on the first control signal to thereby generate a second control signal comprises at least one of:

modulating the step depth signal based on the depth modulation signal to thereby generate a modulated step depth signal; and modulating the step width signal based on the width modulation signal to thereby generate a modulated step width signal; and shaping the gate voltage signal based on the second control signal prior to outputting the gate voltage signal comprises at least one of:

shaping the gate voltage signal based on the modulated step depth signal prior to outputting the gate voltage signal; and shaping the gate voltage signal based on the modulated step width signal prior to outputting the gate voltage signal.

15. The display drive method of claim 13, wherein adjusting the depth of the step over the pulse waveform of the gate voltage signal comprises:

adjusting a number of square wave pulses in each clock cycle.

* * * * *